US006386944B2

(12) United States Patent
Keith et al.

(10) Patent No.: US 6,386,944 B2
(45) **Date of Patent: *May 14, 2002**

(54) BREAST SUPPORT SYSTEM

(75) Inventors: Phyllis Keith, Boise, ID (US); Sarah Lorenz, Spokane, WA (US)

(73) Assignee: Wear Ease, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/908,314

(22) Filed: Jul. 17, 2001

Related U.S. Application Data

(63) Continuation-in-part of application No. 09/595,200, filed on Jun. 16, 2000, now Pat. No. 6,280,287.

(51) Int. Cl.[7] ..... A41C 3/00
(52) U.S. Cl. ..... 450/1; 450/41
(58) Field of Search ..... 450/1, 2, 7, 8, 450/12, 16, 23, 78, 41; 2/105, 106, 104, 69, 113–115, 78.1–78.3, 73, 108, 85, 93, 94, 95, 79

(56) References Cited

U.S. PATENT DOCUMENTS 3,306,299 A * 2/1967 Paramore ..... 450/86
3,465,754 A * 9/1969 Lockwood et al. ..... 450/86
3,827,441 A 8/1974 Rudolph
4,300,568 A 11/1981 Blanckmeister
4,879,766 A 11/1989 Hull et al.
4,917,651 A 4/1990 Rainville
5,032,104 A 7/1991 Rainville
5,149,293 A * 9/1992 Gable ..... 450/86
6,110,007 A * 8/2000 Rittmann ..... 450/86
6,280,287 B1 * 8/2001 Keith et al. ..... 450/1

* cited by examiner

*Primary Examiner*—Gloria M. Hale
(74) *Attorney, Agent, or Firm*—Ormiston & McKinney, PLLC

(57) ABSTRACT

A breast support system for a garment. The system includes a main body formed by shoulder supports, a midriff section, and a pair of breast cups interspaced between and connecting the shoulder supports and the midriff section. A pair of cross tracks pass from one shoulder support over one breast cup, between both breast cups, and then terminating with an exit under the other breast cup. A pair of midriff tracks are affixed to the midriff section each located under one breast cup and below the cross tracks. Grips are affixed to the midriff section between the midriff tracks. The midriff section includes two stays each generally located between a midriff track and the exit of a cross track. Attached to each stay is a guide. A draw strap is loosely guided by each track with one end affixed to a shoulder support and the second end exiting the cross track, passing through one guide, then through one midriff track, and ultimately secured by a grip.

20 Claims, 6 Drawing Sheets

BREAST SUPPORT SYSTEM

CROSS REFERENCE TO RELATED APPLICATIONS

This application is a continuation in part of application Ser. No. 09/595,200 filed Jun. 16, 2000, now U.S. Pat. No. 6,280,287.

FIELD OF THE INVENTION

The present invention relates generally to breast support garments and, more particularly, to a breast support garment that is easier for disabled women to use than conventional brassieres.

BACKGROUND

Disabled individuals, particularly those with arthritis, often encounter difficulty when donning and removing clothing. These difficulties are in large part due to the strength, range of motion, and dexterity required to attach and detach hooks and eyes and to manipulate zippers, buttons and the like. For most people, dressing and undressing is an everyday occurrence that requires little time and thought. However, many disabled persons find the task of dressing and undressing both time consuming and difficult. Brassieres, in particular, present problems for disabled women. In general, a conventional brassiere may be characterized as having three main components. The first component is a pair of cloth cups designed to encircle or partially encircle a woman's breasts. The second component relates to some form of a support system to hold and lift the breasts by providing requisite force on the cloth cups via shoulder straps or otherwise. The third component, a midriff section, is added to prevent the cups from sliding or "creeping" up over the breasts as a result of this upward force. This section, typically an elastic band, is secured to the bottom of each cup and serves to anchor the brassiere to the wearer's midriff region, holding the breast cups in place. The midriff section of conventional brassieres wraps around a person's chest connecting in the front or the back with a series of small hooks and eyes. Those who lack coordination or cannot grip a strap using both arms have extreme difficulty securing the brassiere in place.

Over the past century, countless innovations in brassiere design have been both patented and commercialized, many having in common the sometimes mutually exclusive objectives of providing improved breast support, appearance and comfort. Some are adapted for the needs of women who engage in athletics or who require a bra suitable for wear with strapless, low back or backless apparel. Some are designed for the full figured woman or for less endowed women desiring to enhance their natural appearance. Still others are designed to reshape the breast in a manner believed to be fashionable for a respective time period. Despite the large number of brassiere designs available on the market and disclosed in the prior art there is a remarkable absence of support garments designed to meet the special needs of the disabled.

Conventional brassieres for the most part are ill-suited for the arthritic and the otherwise disabled. Some efforts have been made to design brassieres to meet the special needs of the disabled. For example, U.S. Pat. No. 3,827,441 issued to Lois Rudolph in 1972 discloses a brassiere with an adjustable elastic shoulder support system fitting around the back of the wearer's neck like a halter top. Rudolph's brassiere also includes a midriff section formed by two solid, but flexible, curved stays each attached to one breast cup and extending around one side of the wearer's torso securing the brassiere in place. In 1979 U.S. Pat. No. 4,300,568 issued to Charles Blankmeister for an improved midriff section. The design includes a long draw strap for cinching the midriff section around the wearer's torso. The draw strap passes through two rings. The rings are attached to the opposing sides of the brassiere that pass around to the wearer's back. When the brassiere is in place, the user, with either hand can pull the draw strap, cinching the two sides together in the back.

In 1989 U.S. Pat. No. 4,879,766 issued to Harold Hull for a brassiere design incorporating loops below the breast cups on the front of the garment and a draw strap attached to the midriff section in the back. The wearer, slipping the garment over her head, inserts her thumbs into the loops to pull down from the front and then reaches behind grasping the draw strap to slide the garment into place. Francine Rainville received two patents for a front opening brassiere designed for a handicapped person, specifically, U.S. Pat. No. 4,917,651 issued in 1988 and U.S. Pat. No. 5,032,104 issued in 1990. Rainville's design provides a series of loops allowing a wearer who cannot grip to pull on the loops drawing the front of the brassiere together.

U.S. Pat. No. 5,951,634 issued to Rosie and Tonya Brown in 1998 for a brassiere designed for an arthritic woman. Their design includes detachable shoulder support straps and a midriff section formed by two body straps that cross over each other and pass around the wearer's body below her breasts to attach either in the front or in the back. The shoulder and body straps use Velcro to allow the wearer to more easily remove the garment.

Unfortunately, many disabled women have no, or extremely limited, mobility in one or both arms or hands. While the designs described above provide some limited benefits for many disabled women, none allow a woman to easily slip on, adjust, and later remove a brassiere using only one arm.

SUMMARY

The present invention is directed to a breast support system that is easier for disabled women to use than conventional brassieres. The system includes a main body formed by shoulder supports, a midriff section, and at least one breast cup interspaced between and connecting the shoulder supports and the midriff section. A track passes around at least a portion of the breast cup. A draw strap is loosely guided by the track with one end affixed to a shoulder support and the free end exiting the track.

The midriff section may also include a stay generally located near the exit of the track and a grip. Attached to the stay is a guide. The free end of the draw strap, exiting the cross track, passes through the guide and is received by the grip securing the draw strap.

Not unlike a conventional tank top, a disabled person can slip the garment over her head using one arm. Once in place, each draw strap is gently extended away from the body securing the garment against the body and around the breasts. Passing through the guides, the draw straps also constrict the midriff section providing lateral breast support. The extended draw straps are then secured by the grips. To remove, the garment, the draw straps are released from the grips allowing the garment to loosen. The garment can then be pulled off over the head using one arm.

The invention, as summarized above and defined in the claims at the end of this Specification, may be better understood with reference to the drawings and the following detailed description.

DESCRIPTION

Figure 1:
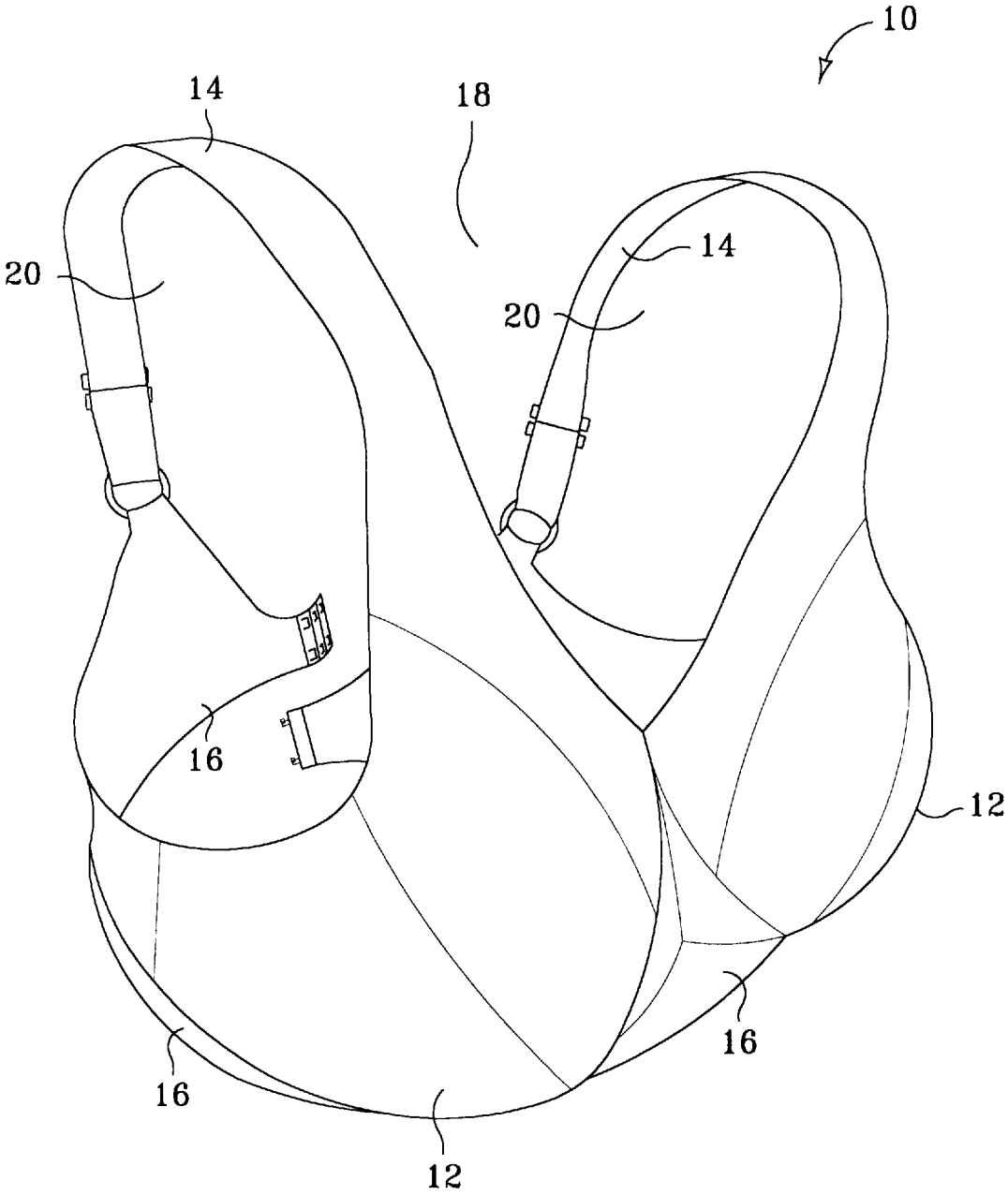
FIG. 1 (Prior Art)
FIG. 1 is an illustration of a conventional brassiere.

While it is envisioned that the present invention will be embodied in a brassiere, it may also be incorporated into any garment—such as a swimsuit for instance—that provides breast support. To better understand the advantages of the subject invention, the construction of a conventional brassiere 10 is illustrated in FIG. 1. Conventional brassiere 10 may be characterized as having three main components. The first component is a pair of cloth cups 12 designed to encircle or partially encircle a woman's breasts. The second component relates to a shoulder support system to hold and lift the breasts by providing requisite upward force on cloth cups 12 via shoulder supports 14 or otherwise. The third component, midriff section 16, provides lateral breast support while preventing cups 12 from sliding or "creeping" up over the breasts. Midriff section 16 is secured to the bottom of each cup 12 in the front and, in many cases, to the shoulder supports 14 in the rear. Section 16 anchors the brassiere to the wearer's midriff region, holding the bottom of cups 12 in place. The design provides a neck opening 18 and two arm openings 20.

Figure 2:
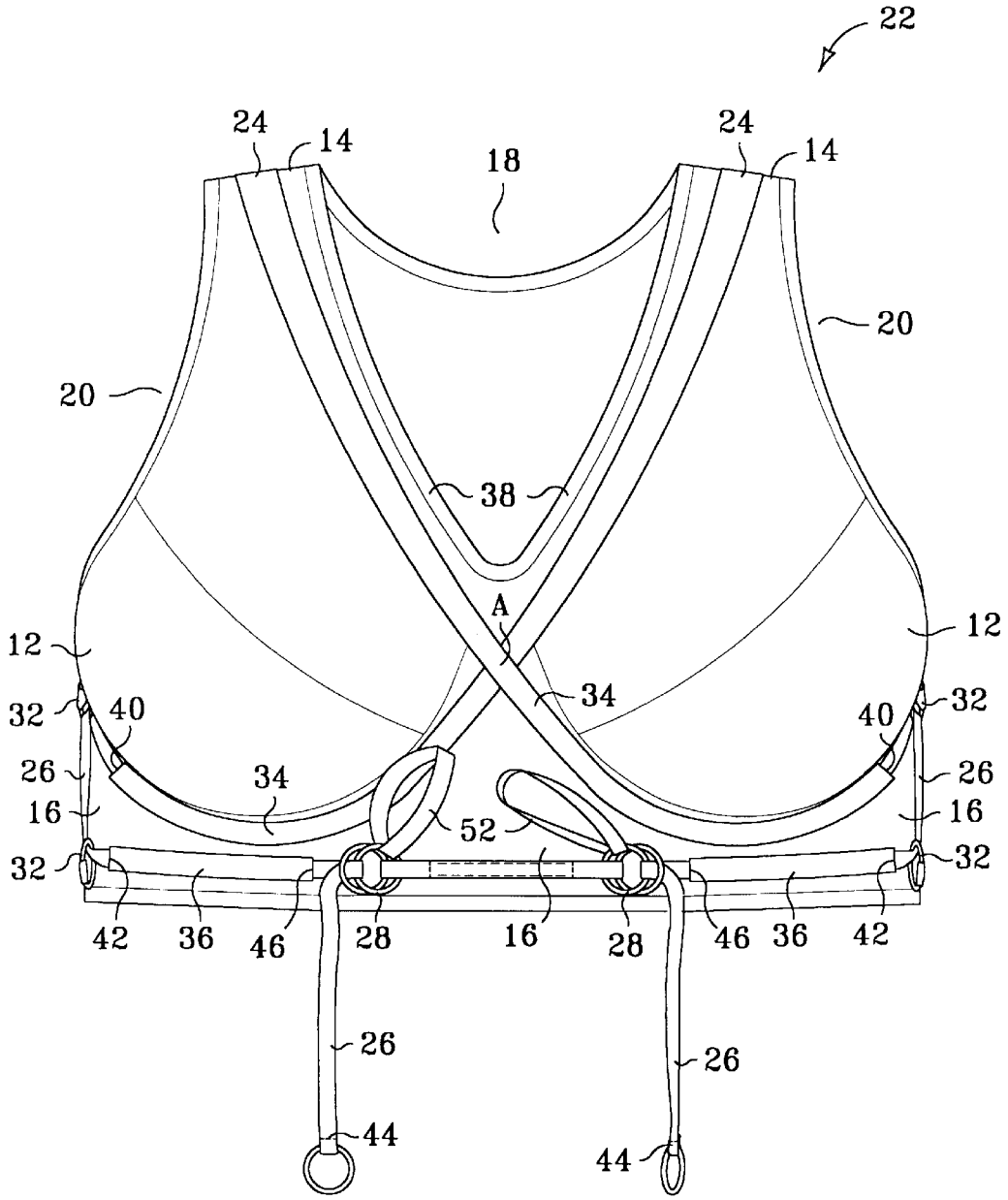
FIG. 2 is a front view of one embodiment of the invented breast support system illustrating the tracks, the draw straps, and grips.
Figure 3:
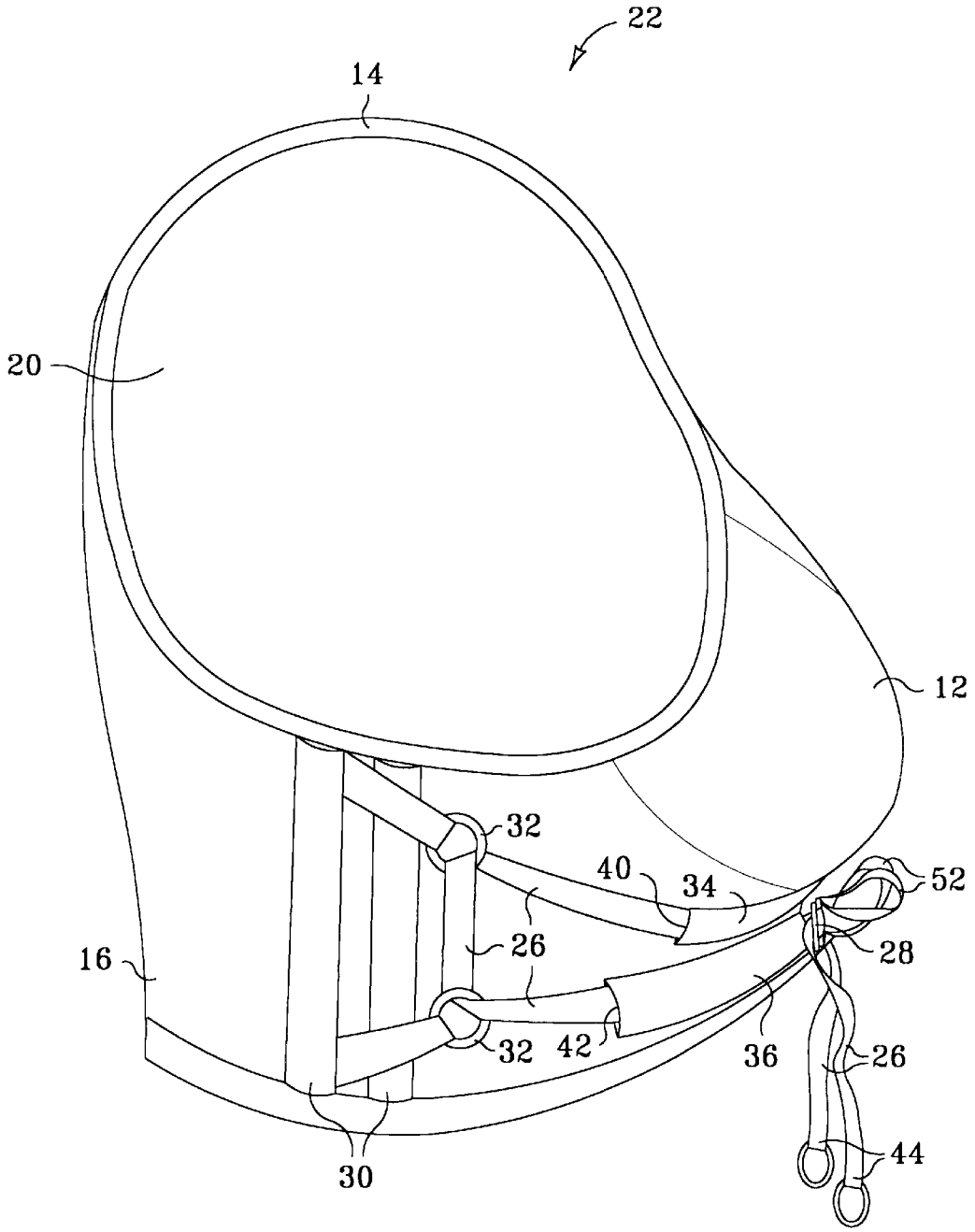
FIG. 3 is a side view of the system of FIG. 2.

Construction: Referring now to FIGS. 2 and 3, the present invention, a breast support system, is incorporated in a brassiere, generally referenced as 22. Brassiere 22 may be put on, adjusted, and later removed using only one arm. In addition to breast cups 12, shoulder supports 14 and midriff section 16—which form the main body of brassiere 22—brassiere 22 includes tracks 24, draw straps 26, buckles 28, and, referring to FIG. 3, stays 30 and guides 32. Tracks 24 represent generally any structure capable of guiding a draw strap along a predetermined path. In the Figures, tracks 24 are illustrated as casings affixed to the body of brassiere 22. The casings form hollow passages and may be constructed from any suitable fabric preferably with a slick texture such as satin or tricot. Each track 24 is made up of a cross track 34 and may include a midriff track 36. Each cross track 34 begins on one shoulder support 14 and traverses along neckline 38 passing over the breast cup nearest the given shoulder support, between both breast cups, and finally under the other breast cup. Each track 24 may, but need not, include midriff track 36 affixed to midriff section 16, passing laterally under one breast cup 12 and below the corresponding cross track 34. The cross and midriff tracks 34, 36 may form one continuous path, or as shown in FIG. 2, each cross track 34 may terminate with an exit 40 above an entrance 42 for the corresponding midriff track 36.

Where casings are used for tracks 24, each casing may be formed by stitching each side of a flat fabric strip to the body of brassiere 22 such that the inside walls of the casing are formed by the fabric strip and the body of brassiere 22. Alternatively, the hollow shape may be achieved by shaping a flat fabric strip into a tube and stitching tube's sides to the body of brassiere 22. In the second case, the inside walls of the casings are formed by the fabric strip. In both cases, the casings cross one another at a point A between breast cups 12. Consequently, at point A one casing is not attached to the body of brassiere 22 but may be attached to the outer surface of the other casing.

Still referring to FIG. 2, guided by tracks 24—draw straps 26 are used to firmly secure brassiere 22. One end of each draw strap 26 is affixed to the shoulder support 14 near the beginning of the cross track 34. Except for its attached end, tracks 24 freely guide each draw strap 36. Where tracks 24 are casings, the draw straps freely pass through the casings and extend through cross track exit 40 and, if present, continuing through and exiting midriff track 36. Free end 44 of each draw strap 36 remains freely accessible near the center of midriff section 16. Grips 28 represent generally any structure capable of securing one or both draw straps 26. To provide easy access, grips 28 are affixed to midriff section 16 below point A near the center of the wearer's chest. However, grips 28 may also be located according to the unique needs of each person. Free end 44 of each draw strap 26 is secured by grips 28.

Figure 4:
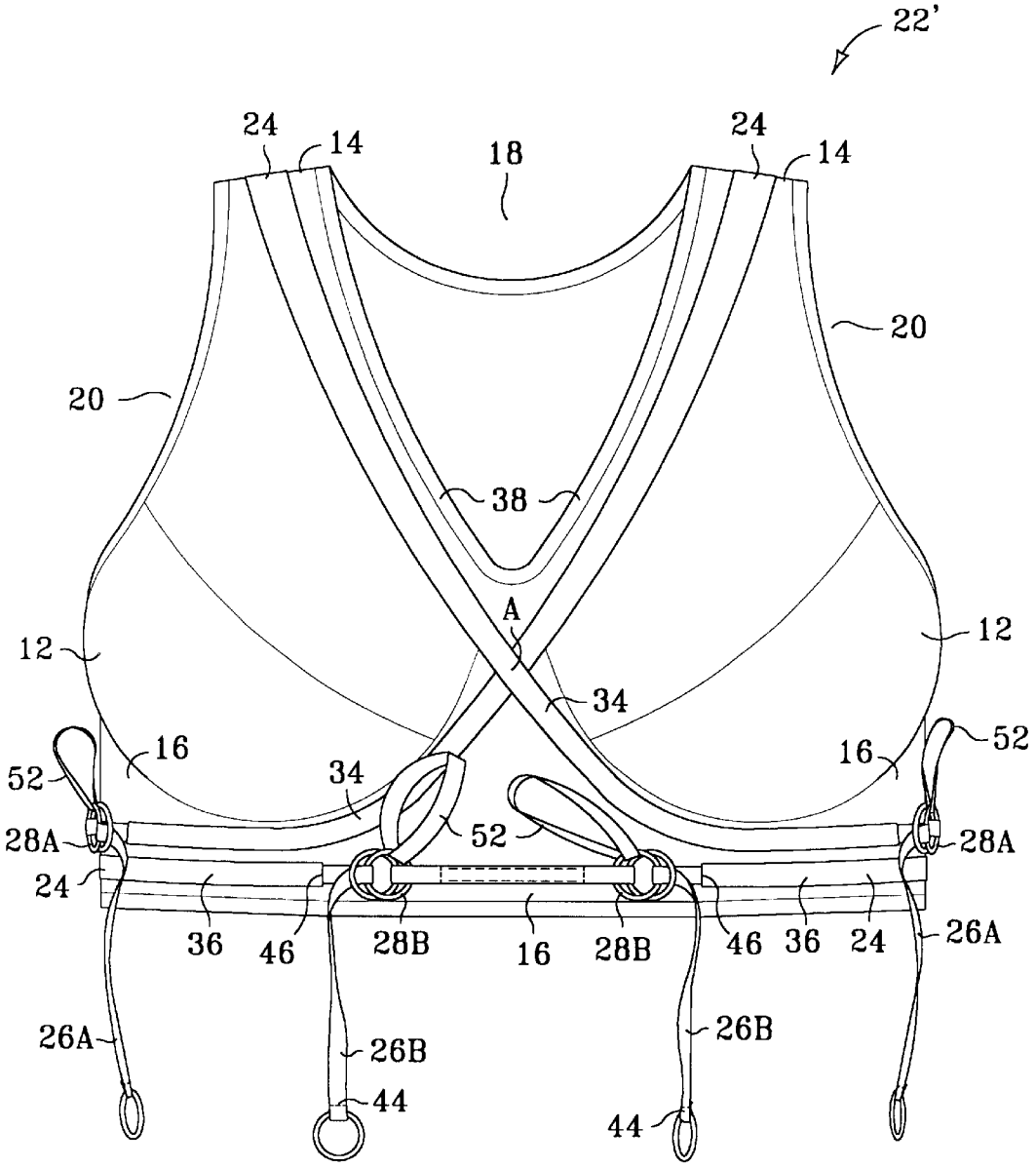
FIG. 4 is a front view of a second embodiment of the invented breast support system illustrating the cross and midriff straps and tracks.
Figure 5:
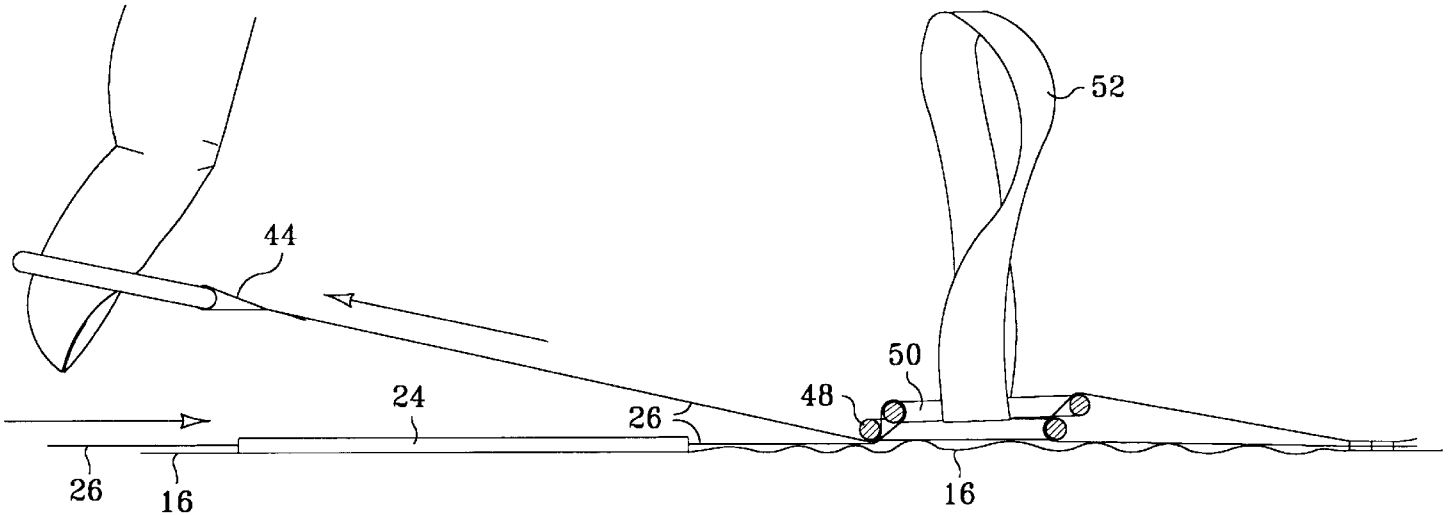
FIG. 5 is a front partial view illustrating how the system of FIGS. 2 and 4 may be adjusted using the draw straps and grips.

In the embodiment illustrated in FIGS. 2, 4 and 5, grips 28 comprise double ring buckles formed by first and second adjacent rings 48, 50. Free end 44 of each draw strap 26 passes through both rings 48, 50 of one buckle 28, around the second ring 50, and then back through first ring 48. As tension in each draw strap 26 urges strap 26 to retreat along track 24, rings 48 and 50 are forced together securely holding each draw strap 26 in place. Conversely, tension in each draw strap 26 urging strap 26 to extend out of track 24 forces rings 48, 50 to separate and allows each draw strap 26 to slide through buckle 28. Each buckle 28 also includes a release 52 attached to the buckle's second ring 50. Release 52 when forced away from buckle 28 separates the rings 48, 50 allowing each draw strap 26 to retreat along each track 24. Alternatively, to secure draw strap 26 to midriff section 16, buckles 28 may be formed using hook and loop fasteners or any other suitable mechanism.

Referring now to FIG. 3, to provide lateral breast support, brassiere 22 also includes stays 30 affixed to midriff section 16 below arm openings 20. Stays 30 may be formed from flexible sew-through polyester boning or any other suitable semi-rigid material. Affixed to each stay 30 are guides 32 for connecting one draw strap 26 to each stay 30. Each draw strap 26, as it leaves a cross track 34, passes through guides 32 and then through a midriff track 36 if present. If the cross and midriff tracks 34, 36 form one continuous track 24, guides 32 may be located within each track 24 and attached to the stay 30. Where casings are used, guides 32 would then be located with each casing and attached to stays 30 through the casings' inner walls. As draw straps 26 are pulled through guides 32, draw straps 26 force stays 30 toward the center of the wearer's chest tightening midriff section 16. It is envisioned that guides 32 will be plastic rings but may be formed in any other shape and of any other material suitable for attaching to stays 30 while transferring the draw straps 26 between the cross track 34 and grips 28.

FIG. 4 illustrates an alternative embodiment of brassiere 22' designed to provide increased support for larger breasts. Here, brassiere 22' incorporate two pairs of draw straps—cross straps 26A and midriff straps 26B. On end of each cross strap 26A is affixed to the shoulder support 14 near the beginning of the cross track 34. Except for the cross straps' attached ends, cross tracks 24 freely guide each draw strap 36. Where cross tracks 24 are casings as shown in FIG. 4, the draw straps freely pass through the casings. One end of each midriff strap is affixed to the midriff section 16 generally beneath an arm opening 20. If the brassiere 22' incorporates stays 30, those ends may be affixed to stays 30. Except for the midriff straps' attached ends, midriff tracks 24 freely guide each midriff strap 36. Where midriff tracks 24 are casings as shown in FIG. 4, the midriff straps 26B freely pass through the casings.

The alternative embodiment also incorporates cross grips 28A and midriff grips 28B. Cross grips 28A represent generally any structure capable of securing cross straps 26A while midriff grips 28B represent generally any structure capable of securing midriff straps 26B. It is envisioned that cross and midriff grips 28A and 28B will be buckles capable of receiving and securing a free end of a cross or midriff strap 26A or 26B. Cross grips 28A are affixed to the midriff section 16 generally under an arm opening 20, while the midriff grips 28B are affixed to midriff section 20 generally below and between breast cups 12.

In many cases it may be desirable to include additional base support under breast cups 12. The base support may be in the form of an under wire incorporated into the fabric of the garment along the intersection of the base or underside of each breast cup 12 and midriff section 16. Similarly, polyester boning or any other suitable semi-rigid material could be inserted into the portion of each cross casing 26A that passes under a breast cup 12. The base support helps to hold each breast cup 12 in place.

Use: To don either brassiere 22 or 22' the wearer's arms slip though openings 20 allowing the brassiere to slide past each elbow. The back of the brassiere is gathered up and slipped over the wearer's head like a tank top or any other pullover top. With one arm, the wearer can pull brassiere 22 or 22' down loosely securing the wearer's breasts in each cup 12.

To secure brassiere 22 (shown in FIGS. 2 and 3) in place and to provide increased breast support, the wearer pulls on the free end 44 of each draw strap 26 securing tracks 24 firmly against the wearer's chest and around each breast. As the draw straps 26 slide through guides 32, inward tension is applied to midriff section 16 forcing each stay 30 toward the center of the wearer's chest. This force tightens section 16 around the wearer's torso and provides lateral breast support.

Figure 6:
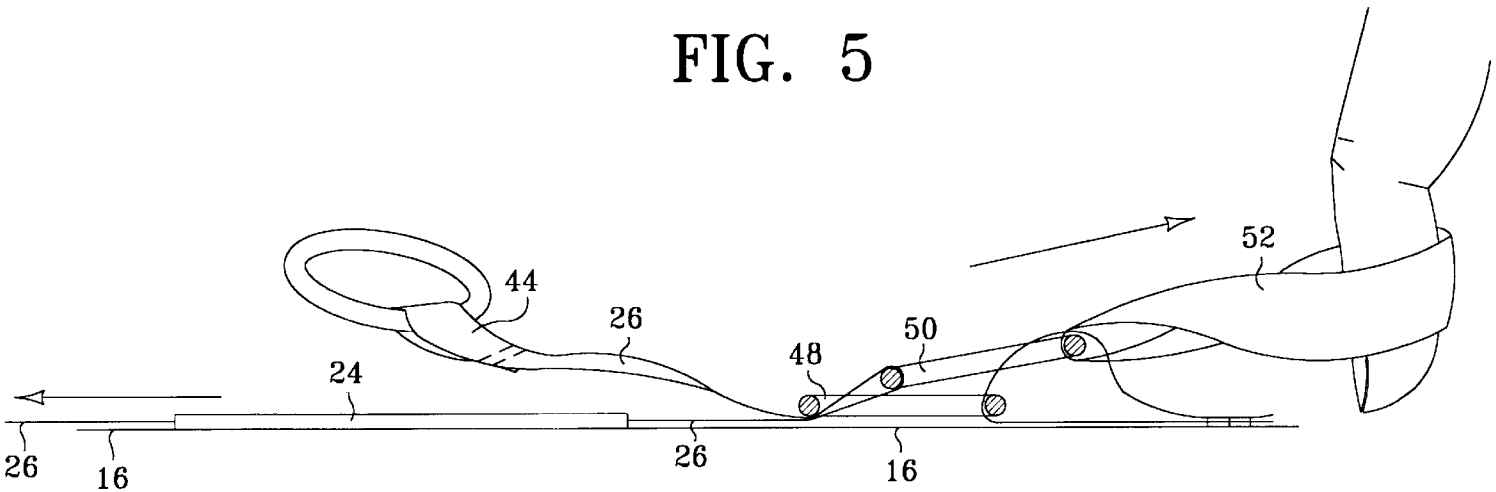
FIG. 6 is a front partial view illustrating how the draw straps in the system of FIGS. 2 and 4 may be released from the buckles.
Figure 7:
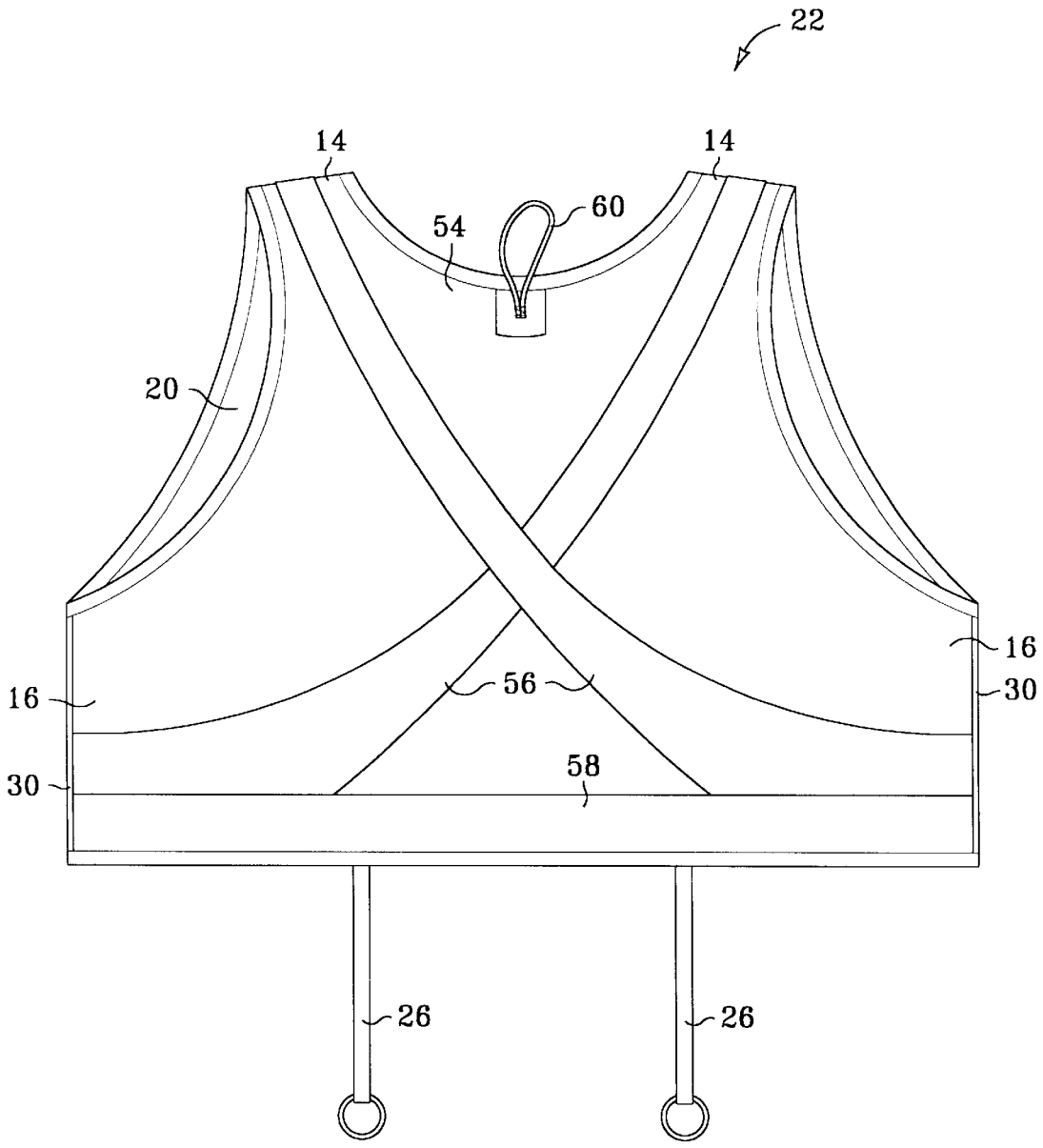
FIG. 7 is rear view of the system brassiere of FIGS. 2 and 4 illustrating the high back, cross bands, torso band, loop, and mid-back support.

Referring to FIG. 6, to loosen brassiere 22, the wearer pulls on each release 52 allowing draw straps 26 to retreat within tracks 24. To allow the wearer to easily slip brassiere 22 over the head, brassiere 22 may incorporate high back 54 connecting shoulder supports 14 to midriff section 16 along the wearer's back as shown in FIG. 7. It is expected that high back 54 will be formed by a solid piece of cloth not unlike the back of a conventional tank top. The wearer can grasp high back 54 in one hand and slide brassiere 22 over the wearer's head. To provide additional back support, it is envisioned that high back 54 will include cross bands 56. Each cross band 56 traverses from one shoulder support 14 across high back 54 to an opposing stay 30. Cross bands 56 may be stitched into the high back 54 or connected directly to the shoulder supports 14 and stays 30, or both. FIG. 6 also illustrates torso band 58 starting beneath one arm opening 20 traversing around the back of the garment and ending under the other arm opening. As the wearer pulls on each draw strap 26 forcing each stay 30 toward the center of the wearer's chest, cross and torso bands 56 and 58 tighten across the wearer's back. Cross and torso bands 56 and 58 may be elastic or constructed of a more firm material. The high back 54 may also incorporate a loop 60 or other structure allowing the wearer to easily grasp the back 54.

To secure brassiere 22' (shown in FIG. 4) in place and to provide increased breast support, the wearer pulls on the free end 44 of each cross and midriff strap 26A and 26B securing cross tracks 34 firmly against the wearer's chest and around each breast. As the midriff straps 26B slide through midriff tracks 36, inward tension is applied to midriff section 16 forcing each stay 30 toward the center of the wearer's chest. This force tightens section 16 around the wearer's torso and provides lateral breast support. To loosen brassiere 22', the wearer pulls on each release 52A and 52B allowing cross and midriff straps 26A and 26B to retreat within tracks 34 and 36.

For purposes of convenience and clarity, FIGS. 2–4 illustrate brassieres 22 and 22' incorporating the present invention. However, the invented breast support system may be incorporated into any garment in which it is desirable or necessary to provide breast support. Such other garments include swimming suits and exercise clothing. Although the invention has been shown and described with reference to the foregoing exemplary embodiment, various other embodiments, additions and modifications are possible without departing from the spirit and scope of the invention as defined in the following claims.

What is claimed is:

1. A support garment having a body formed, at least in part, by shoulder supports, a midriff section, and a pair of breast cups interspaced between and connecting the shoulder supports and the midriff section, the garment comprising:

a pair of cross draw straps each having one end affixed to a shoulder support and the other end remaining free;

a pair of cross tracks, each cross track configured to guide one cross draw strap from one shoulder support over one breast cup, down and across between both breast cups, and continuing across and under the other breast cup;

a pair of cross grips configured to secure the cross draw straps;

a pair of midriff draw straps each having one end affixed to the midriff section and the other end remaining free;

a pair of midriff tracks, each midriff track guiding one midriff draw strap beneath one breast cup; and a pair of midriff grips configured to secure the midriff draw straps.

2. The garment of claim 1, wherein the cross tracks and the midriff tracks each comprises a casing.

3. The garment of claim 1, wherein the cross grip comprises a pair of buckles each configured to secure the free end of one cross draw strap and the midriff grip comprises a pair of buckles each configured to secure the free end of one midriff draw strap.

4. The garment of claim 1, wherein a portion of each cross track that passes beneath a breast cup incorporates a base support.

5. A support system for a garment having breast cups, the system comprising:

a pair of cross draw straps, one end of each cross draw strap affixed to the garment and the other end remaining free;

a pair of cross tracks, each cross track guiding a cross draw strap over one breast cup, between both breast cups, and under the other breast cup; and a pair of cross grips each configured to secure the cross draw straps.

6. The system of claim 5, wherein a portion of each cross track that passes beneath a breast cup incorporates a base support.

7. The system of claim 5, further comprising:

a pair of midriff draw straps, one end of each midriff draw strap affixed to the garment and one end remaining free; and a pair of midriff tracks, each midriff track guiding a midriff draw strap generally along and beneath one breast cup; and a midriff grip configured to secure the midriff draw straps.

8. The system of claim 6, wherein the midriff grip is located generally beneath and between the breast cups and each cross grip is located beneath one breast cup on a side of the breast cup opposing the midriff grip.

9. The system of claim 6, wherein:

the cross grips comprises a first pair of buckles, each buckle configured to secure the free end of one cross draw strap; and the midriff grip comprises a second pair of buckles, each buckle configured to secure the free end of one midriff draw strap.

10. A breast support system for use in a garment having at least one breast cup, the system comprising:

a draw strap having one end affixed to the garment and the other end remaining free; and a track guiding the draw strap generally over and around at least a portion of the breast cup.

11. The system of claim 10, wherein the track comprises a casing.

12. The system of claim 10, further comprising a midriff track configured to guide the draw strap generally along and beneath the breast cup.

13. The system of claim 10, further comprising a grip configured to secure the draw strap.

14. The system of claim 13, wherein the grip comprises a buckle.

15. The system of claim 13, further comprising a guide for transferring the draw strap from the track to the grip.

16. The system of claim 9, further comprising:

a midriff draw strap having one end affixed to a midriff section of the garment and the other end remaining free; and a midriff track configured to guide the midriff draw strap generally along and beneath the breast cup.

17. The system of claim 16, wherein the midriff track comprises a casing.

18. The system of claim 16, further comprising a midriff grip configured to secure the midriff draw strap.

19. The system of claim 18, wherein the midriff grip comprises a buckle configured to secure the free end of the midriff draw strap.

20. The system of claim 18, wherein the midriff grip and the cross grip are located generally beneath and on opposing sides of the breast cup.

* * * * *